United States Patent [19]

Zolnierczyk et al.

[11] Patent Number: 4,676,775

[45] Date of Patent: Jun. 30, 1987

[54] FLUID ADMINISTRATION APPARATUS AND METHOD

[75] Inventors: Kenneth J. Zolnierczyk, Chicago, Ill.; David M. Roxe, 2626 N. Lakeview Ave., Chicago, Ill. 60614

[73] Assignee: David M. Roxe, Chicago, Ill.

[21] Appl. No.: 624,959

[22] Filed: Jun. 27, 1984

[51] Int. Cl.[4] ..... A61J 1/00; A61J 7/00

[52] U.S. Cl. ..... 604/28; 604/29; 604/82; 604/87; 604/56; 604/410; 604/414; 604/416

[58] Field of Search ..... 604/29, 28, 82, 87, 604/88, 56, 262, 408–411, 414, 416, 905

[56] References Cited

U.S. PATENT DOCUMENTS

| | | | |
|---|---|---|---|
| 1,943,120 | 1/1934 | Kabnick | 604/87 |
| 4,209,013 | 6/1980 | Alexander et al. | 604/29 |
| 4,392,851 | 7/1983 | Elias | 604/416 |

FOREIGN PATENT DOCUMENTS

| | | | |
|---|---|---|---|
| 2541377 | 4/1976 | Fed. Rep. of Germany | 604/82 |

*Primary Examiner*—John Doll
*Assistant Examiner*—Chung K. Pak
*Attorney, Agent, or Firm*—James T. FitzGibbon; Angelo J. Bufalino

[57] ABSTRACT

A fluid administration apparatus which comprises a fluid receptacle and a fluid administration conduit assembly having a hollow fluid administration tube, a handle and a hollow spike unit extending axially outwardly from said handle said handle and said fluid tube being adapted to be positioned exterior to said receptacle and said spike being adapted to be positioned within said receptacle, said spike including a shank and a tip and said receptacle comprising two fluid chamber separated by a pierceable membrane.

12 Claims, 10 Drawing Figures

FLUID ADMINISTRATION APPARATUS AND METHOD

BACKGROUND OF THE INVENTION

The present invention relates generally to medical devices, and more particularly, to apparatus primarily intended for peritoneal dialysis or other medical treatment of humans or animals, wherein the administration of fluids in relatively large quantities is required for such treatment.

Today, so-called peritoneal dialysis is becoming increasingly common. With this form of treatment, a fluid is periodically or continually introduced into the peritoneum and then withdrawn therefrom. Toxic substances enter the fluid while it is in the peritoneum and are removed when the fluid is drained.

As in the administration of other fluids for medical use, a chronic problem in the industry has been to insure that the "spike" which forms one end of the administration apparatus is in an aseptic condition and is maintained in this condition, especially just prior to insertion thereof into a bag, bottle or other container for the dialyzing fluid, so that fluid which is sterile or aseptic as packaged does not become contaminated just before or during administration.

Some methods of approaching this problem in the past have included removal of the spike from a protective sheath or the like before insertion into the bag or the like. In such an apparatus, there is always the possibility of contamination of the spike between the time it is removed from a sheath and sterilized and the time it is inserted into the bag or other container for fluid. Futhermore, there is also the chance that contamination will occur by reason of the entry of the spike into the bag or bottle, that is, by contact with contamination existing on the exterior pierceable surfaces of the bag or the like.

Other methods have been proposed in which the spike may be sterilized by radiation or by sterilizing fluids, but wherein the sterilizing fluid may be transferred from the spike into the receptacle for the dialyzing fluid or other fluid to be administered. Bearing in mind that spikes are hollow, it will be appreciated that the possibility of filling the interior of the spike with a fluid other than the dialyzing fluid can create its own problems, particularly in parenteral fluids administration.

According to the present invention, an improved apparatus and method is provided for sterilizing a spike or like portion of a dialysis apparatus without compromising the sterility of the system as a whole and also without the need to introduce foreign fluids themselves as contaminants of the fluid contained in the bag or bottle, or to change the composition of the final fluid administered to the patient.

According to the invention, the bag or like container for the administered fluid is subdivided into a major chamber and a smaller chamber which is not originally in communication with the first chamber. In a preferred form, the first or larger chamber contains a fluid which is not suitable for administration until mixed with the contents of the second chamber, and the second chamber contains a fluid not suitable for administration until mixed with the contents of the first chamber. For example, it may contain saline or like solution, in much greater concentration in the chamber of reduced volume and much lower concentration in the chamber of larger volume. According to the invention, the smaller chamber includes a pierceable or rupturable portion with a pierceable or rupturable membrane forming a part thereof and adapted, when pierced or otherwise ruptured, to maintain a fluid-tight seal. The smaller chamber is also arranged for bellows like or axial contraction when desired, and is arranged so that either a portion thereof, an insert therein, or the spike itself may be forced into the larger chamber through a second or subdividing membrane, with the dual result that the fluid previously contained in the smaller chamber is forcibly expelled from the first chamber into the enlarged chamber wherein dilution takes place, the spike having been sterilized by its initial contact with the concentrated fluid in the first chamber.

In another embodiment, the fluids are different but compatible, and the sterilizing fluid is non-objectionable from the standpoint of administration to the patient.

Inasmuch as the fluids are always both compatible and suitable for the intended purpose when admixed, the needle may be sterilized, the entry of foreign matter is completely prohibited, and the need for providing complex directions concerning sterilizing procedures or the like may be obviated.

According to a preferred form of the invention, the receptacle for the fluid comprises a bag or the like having a neck portion extending outwardly therefrom and sealed off by a subdividing membrane which forms the inner end wall of the smaller chamber. The smaller chamber likewise includes an exterior end wall or membrane and flexible side wall portions. Preferably it also includes a combination interior needle sheath, guide and holder permitting desired safety and operational features, as will appear. Bayonet locks or the like may also be utilized to insure retention of the needle with respect to the bag as a whole. The administered fluid is preferably a saline solution or the like, but according to the invention, a number of fluids have been found which quite surprisingly serve as disinfectants or sterilizing agents in high concentrations and yet which are compatible with water or other fluids so as to provide appropriate concentrations of a dialyzing or like solution.

In view of the need for improved apparatus for peritoneal dialysis or other medical applications, it is an object of the present invention to provide an improved combination fluid storage receptacle and sterilizing apparatus.

Another object of the invention is to provide an improved method of sterilizing spikes or like devices, used in medical fluid administration, particularly those adapted for simple manufacture at low cost and ease of operation.

Another object of the invention is to provide a method of sterilizing a spike or the like which involves immersing the spike in a solution having a first ingredient concentration for a period of time sufficient to permit reduction of the bacteria or other contamination count to a medically acceptable level, and subsequently using the fluid just utilized to sterilize the needle as an additive or diluent for another volume of the same or similar fluid to create a single solution which may be administrated through the thus-sterilized spike.

Another object of the invention is to provide a bag or like fluid administration apparatus having an enlarged first storage chamber a second sterilizing chamber of reduced volume, a pierceable subdividing membrane separating the two chambers and a pierceable membrane disposed on and forming a part of the exterior of the reduced volume chamber, with the smaller chamber being, in its extended condition, just larger axially than the length of the associated spike or like device.

Another object of the invention is to provide a medical apparatus having a spike or like device adapted to pierce a container membrane, a bag having first and second chambers isolated from each other by a pierceable or rupturable membrane, first and second fluid chambers and a needle locating device contained in the smaller of the chambers and with the smaller chamber being filled with a sterilizing fluid, and with the larger chamber being filled by a compatible fluid for administration to a patient.

A still further object of the invention is to provide a method of sterilizing a spike which involves transiently immersing it in a solution adapted for peritoneal dialysis, with the solution being a concentrated saline solution, a diluted form of which is adapted for administration for peritoneal dialysis.

The foregoing and other objects and advantages of the invention are achieved in practice by providing a bag or like fluid container unit adapted to receive and hold a hollow spike and tube, with the container being subdivided into a first, larger contents container and a much smaller sterilizing fluid container, with the two containers having common exterior walls and being separated from each other by a pierceable or rupturable subdividing membrane, with the smaller chamber being generally in the form of a cylindrical neck which is axially collapsible so that a needle may be positioned and held in the smaller chamber for sterilizing, and subsequently moved axially, along with a portion of the chamber walls, so as to pierce the membrane and expel sterilizing fluid into the larger chamber, and then permit the mixed fluids to flow through the hollow needle to the patient. The larger chamber is preferably filled with the same fluid as that contained in the smaller chamber, except that the fluid in the smaller chamber is of a much different concentration, or in the alternative, two compatible fluids are used, and selected so that the first will sterilize the needle but will also mix with the other fluids so that the combined or mixed fluid may be administered to the patient without harm.

The exact manner in which the invention achieves these and other objects and advantages will become more clearly apparent when reference is made to the following detailed description of the preferred embodiments of the invention set forth by way of example, and shown in the accompanying drawings, wherein like reference numbers indicate corresponding parts throughout.

DESCRIPTION OF THE PREFERRED EMBODIMENTS OF THE INVENTION

Figures 1, 2, 3, 4:
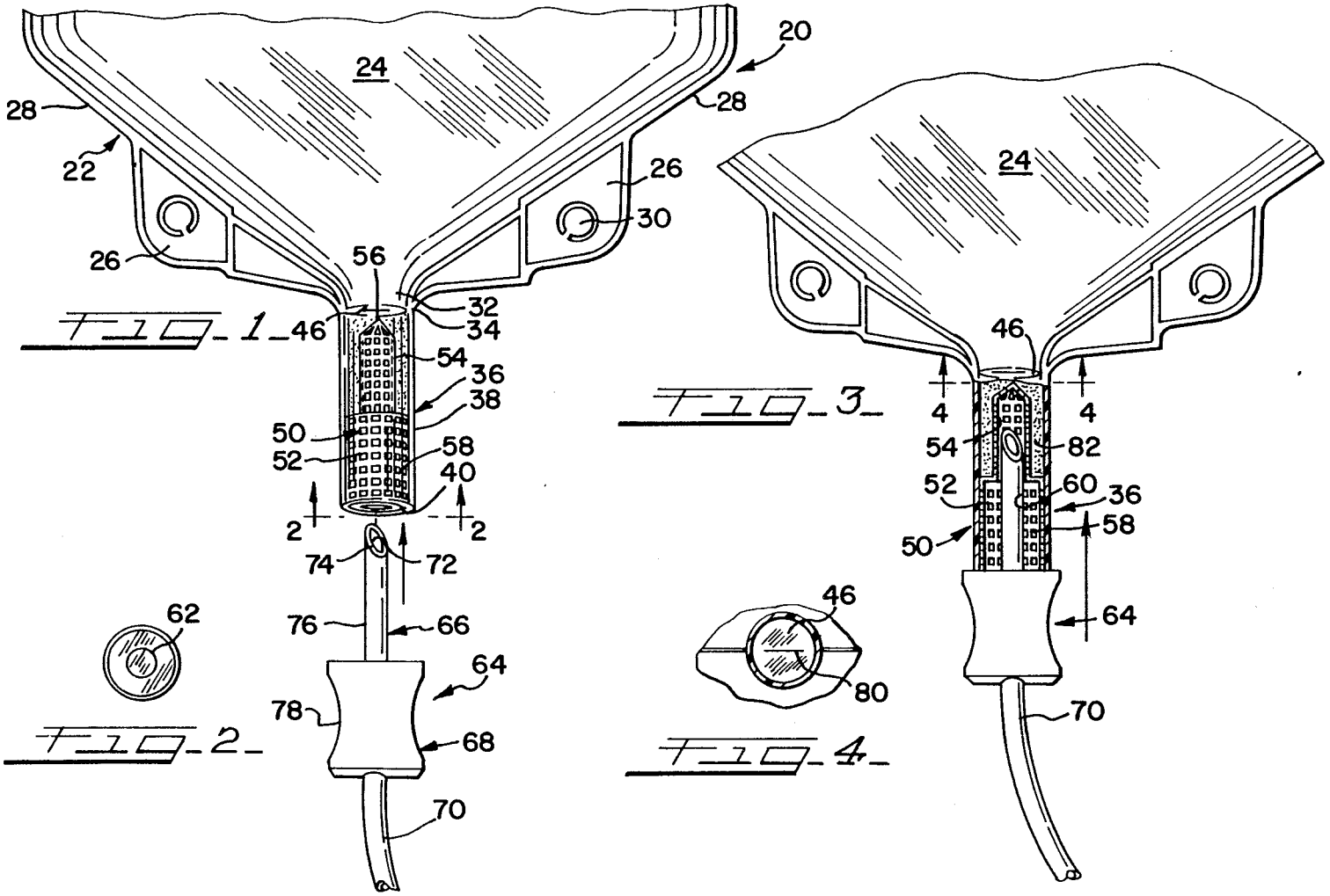
FIG. 1 is a side elevational view, with portions broken away, of a portion of the fluid administration apparatus in the invention, showing the spike shank, the spike holder, and the fluid conduit just prior to insertion within the smaller or sterilizing chamber of the container unit.
FIG. 2 is an end view of the sterilizing chamber of compartment of the fluid container, taken along lines 2—2 of FIG. 1.
FIG. 3 is a view, partly in elevation and partly in section, of the apparatus of FIG. 1, showing the spike inserted within a guide lying in the smaller chamber of the fluid container unit for sterilization.
FIG. 4 is a horizontal sectional view of the sterilizing chamber and showing the subdividing membrane lying between the fluid container and the sterilizing chamber.
Figure 7:
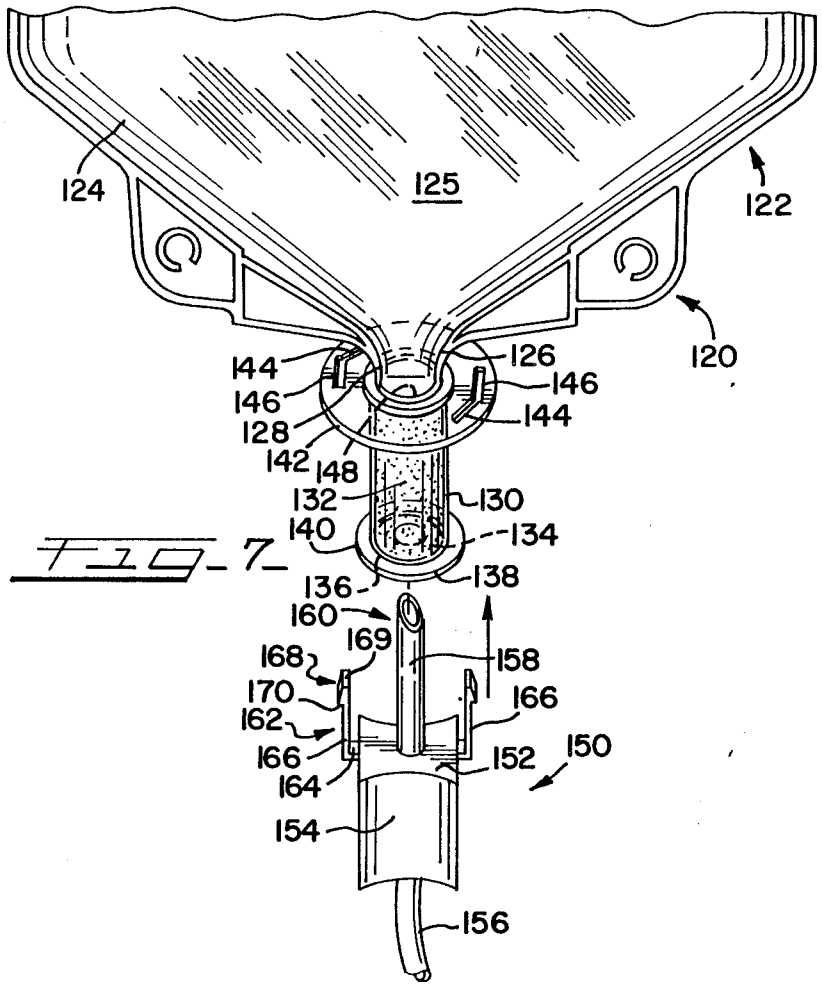
FIG. 7 is an exploded perspective view, with portions broken away, of a modified form of fluid administration apparatus made according to the invention.

While it will be understood that the apparatus of the invention may be used in different applications, a description of a preferred form thereof will be given in relation to an application wherein the fluid to be administered is a saline or like solution, where the patient is human, and the operation is a peritoneal dialysis operation involving the periodic supply of dialysate to the peritoneum from supply bags containing this solution.

Referring now to the drawings in greater detail, FIGS. 1–6 show the important elements of a fluid administration apparatus incorporating the invention and generally designated 20. These elements include a container generally designated 22 in the form of a bag having a main body portion 24 and preferably being made from a flexible thermoplastic material. The bag includes a pair of substantially identical shoulder flaps 26 formed along one of several bag seams 28 and is shown to include perforated portions 30 defining openings for locating the bag, as by a holder stand (not shown) or the like. The bag portion also 24 also includes a reduced diameter neck 32 which terminates at a shoulder 34, with the shoulder having depending therefrom a generally cylindrical sterilizing chamber generally designated 36 and defined in part by a circular sidewall 38, and an end wall portion 40.

The sterilizing chamber 36 is separated from the chamber formed in the interior of the bag 24 by a separating membrane 46 extending transversely across the reduced diameter section of the bag adjacent the shoulder 34.

In the form shown, the generally cylindrical smaller chamber 36 includes therein a separately formed combination needle guide and membrane piercing element generally designated 50 and shown to include an enlarged diameter, lower body portion 52 and a reduced diameter upper body portion 54 extending axially upwardly therefrom and terminating in a pointed end portion 56. A plurality of body apertures 58 are provided in spaced apart relation relative to the needle guide 50, with such apertures extending into and communicating with the open cylindrical center section 60 of the unit 50. In the preferred form, the end wall 40 of chamber 36 has a marked or weakened area 62 adapted for registry with the center section 60 to aid alignment of the spike, as will be described.

Referring now to another element of the invention, a needle and tube assembly generally designated 64 is shown to include a needle generally designated 66, a finger gripping handle portion 68 and a supply tube 70. The spike 66 is an otherwise conventional hollow type spike having a central bore or passage 72, a tapered, sharpened end portion 74 and a cylindrical shank 76, being joined in a conventional manner to an open end portion of the tube 70. The handle or gripping portion 68 preferably includes a reduced diameter or otherwise contoured center section 78 to facilitate handling or gripping.

Referring again to FIGS. 1-3, it will be understood that in use, the bag 24 is filled with dialyzing fluid and that, according to the invention the interior 82 of the chamber 36 is filled with a sterilizing solution which, according to the invention, is preferably a concentrated form of the same solution in the larger chamber 24. According to the invention, the smaller chamber 36 is able to be pierced readily by the needle without leaking.

Figure 5:
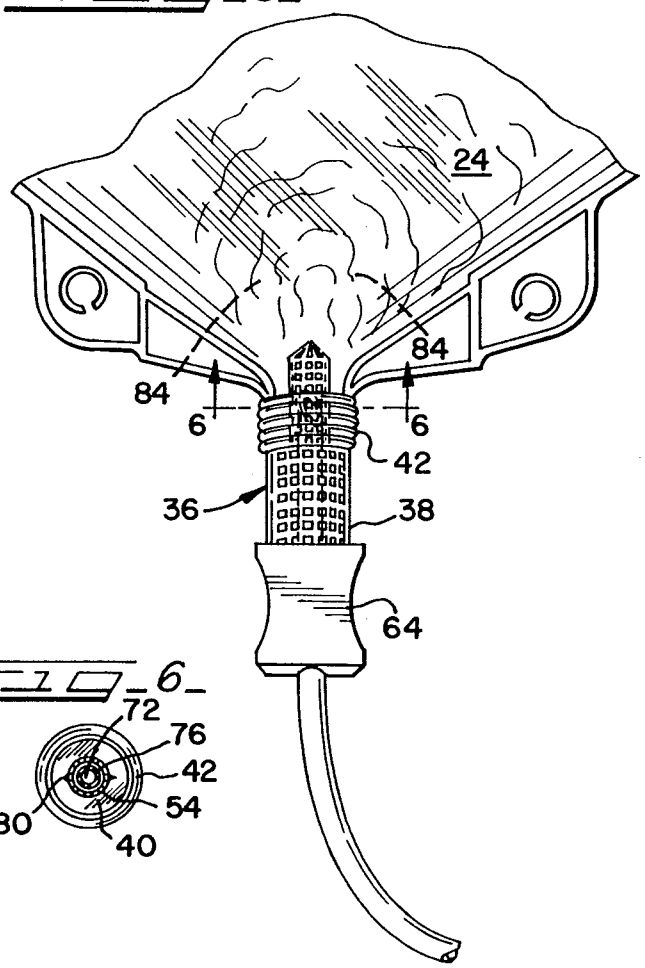
FIG. 5 is an elevational view of the apparatus of FIGS. 1–4 showing the separating membrane being broken by the spike guide and showing the smaller chamber being telescoped so as to expel fluid into the longer chamber.
Figure 6:
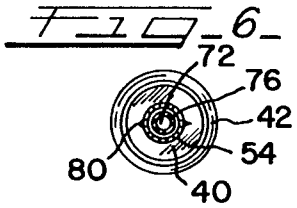
FIG. 6 is a horizontal sectional view of the container assembly of FIG. 5 taken along lines 6—6 thereof.

Accordingly, in operation, as will appear from a consideration of FIGS. 3 and 5, when the patient has removed the spike from the earlier used bag, a new, full bag is selected and the needle is inserted, the needle is inserted rapidly through the end wall 40 of the smaller chamber 36 of the new bag until the spike reaches the position shown in FIG. 3. At this point, the spike shank 76 lies within the cylindrical opening 60 in the center of the holder 50. Because of the perforated or foraminous nature of the spike holder and membrane piercing unit 50, the spike is opened to flow of fluid in the chamber 82 to and against its end and side wall portions for sterilizing purposes.

Thus, if the spike is not already free of contamination being inserted and remaining in the smaller chamber 50 exposes the needle to the bathing action of the fluid in the chamber 82. After a suitable residence time, usually only a matter of minutes or more, sufficient sterilization for improved patient safety has occurred. An incidental feature of the construction of the needle guide 50 is apparent from FIG. 3, in that the interior surfaces of upper body 54 of the guide 50 provides fit with the shank 76 of the needle 66 which is loose enough to allow fluid flow along the shank of the spike inside the guide. The fit still helps guide the needle, however. This assists in holding the weight of the needle and its supported tube rather than having the handle 64 and tube 70 be supported merely by ane fit between the end wall 42 of the cylindrical chamber 36 and the needle 66.

Referring now to FIG. 5, the novel action of the apparatus of the invention may be appreciated. Here, after the operator has inserted spike 66 into the smaller chamber 36, both the spike assembly and the guide 50 are pushed as a unit axially upwardly (as in FIG. 5), causing the tip 56 of the guide 50 to pierce the subdividing membrane 46. The sidewalls 38 of the chamber 36 may be distorted temporarily by this compressive action.

The axially telescoping or compressive action of spike movement not only pierces the membrane 46, but axially telescopes or collapses the sidewalls 38 of the chamber 36 into a bellows-like series of folds 82, accommodating the reduced volume thereby created. This action forcibly expels fluid, designated 84 in broken lines, from the smaller chamber wherein it is held in concentrated form into the bag 24, where it is permitted by the elapse of a short time, to be diluted by the solution in the bag 24. The membrane piercing element 50 is then returned to its original position of FIGS. 1 or 3 by releasing force on the unit 64. At this point, shortly after piercing the membrane 46, the two solutions respectively disposed in the larger and smaller chambers of the fluid container have become mixed to the point that their concentrations are essentially the same, and the fluid is suitable for administration to the patient.

The sterilization process has taken place entirely within the bag and there is no possibility of exposure of the needle to the atmosphere or to a contaminating source intermediate its sterilization and its making contact with the interior of the container holding the fluid which is to be administered. By reason of using the large piercing element 50 which also acts as the needle guide and support, the membrane 46 is torn sufficiently to permit free fluid flow between chambers. FIG. 3 illustrates the position of the elements during administration, it being understood that the membrane 46 has been broken sufficiently to allow free fluid flow therethrough.

From a consideration of the foregoing, it will be seen that the sterilizing and feeding steps are the ultimate in simplicity, and that, assuming the person is properly instructed, no particular skill is required to successfully achieve initial sterilization, and subsequently, administration of fluid. The arrangement of the spike support or guide 50 is such that, when the spike is first inserted, the ennlarged portion 58 of the body is held against accidental piercing of the membrane 56, and this will normally occur only as a conscious act, adding a degree of safety to the use of the apparatus.

Referring now to another aspect of the matter, tests have been conducted concerning concentrations of selected fluids, residence time and reduction of baterial count therein, with such tests results being synopsized in Table 1, referred to below.

Bacteriologic studies performed in vitro demonstrated the efficacy of the concentrated salt solution in reducing bacterial proliferation. Four common, infective strains of bacteria were used: Staphylococcus aureus, Staphylococcus epidermidis, Escherichia coli, and Pseudomonas aeruginosa. Each organism was grown in a broth that was adjusted to contain approximately 1,000 organisms per milliliter of solution. Stimulated "spikes" were dipped into the bacterial broth, and then placed into a concentrated salt solution (27.5% sodium chloride solution) for 5 minutes. Aliquots of the concentrated salt solution were then cultured, and compared to controls which were not exposed to the concentrated salt solution.

TABLE I

| Organism | Mean Colony Count | No. of Incubations | Statistical Probability |
|---|---|---|---|
| *Staphylococcus Aureus* Control | 44.0 | 6 | $p < .0025$ |
| Concentrated Salt Solution | 0.33 | 6 | |
| *Staphylococcus Epidermidis* Control | 193.7 | 6 | $p < .0005$ |
| Concentrated Salt Solution | 0.42 | 6 | |
| *Escherichia Coli* Control | 223 | 6 | $p < .0005$ |
| Concentrated Salt Solution | 0 | 6 | |
| *Pseudomonas Aeruginosa* Control | 70 | 6 | $p < .01$ |

TABLE I-continued

| Organism | Mean Colony Count | No. of Incubations | Statistical Probability |
|---|---|---|---|
| Concentrated Salt Solution | 0 | 6 | |

The foregoing examples illustrate the use of preferred amounts of sodium chloride as sterilizing agent. The reduction in bacteria colony count in all cases is easily sufficient to eliminate, for practical purposes, the bacteria as a hazard in the dialysis or like treatment. In other words, an administration of fluid according to the present invention is made to a patient whose host defense mechanism is active, and will readily eliminate any contamination hazard arising from a spike which might have the indicated trace quantities thereon. It is only in those cases wherein the size or strength of the innoculum is large in relation to the host defense response that a heath hazard is presented to the patient; in the present case, the post-treatment levels are far below those medically likely to create health hazards.

Referring now to FIGS. 7–10, an alternative form of apparatus generally designated 120 and having the same use as the embodiments of FIG. 1–6 is shown. This unit includes a bag portion generally designated 122, having exterior walls 124 defining a principal fluid chamber 125 and terminating at its lower end at a shoulder 126, below which lies a neck 128. Disposed therebeneath are exterior sidewalls 130 forming a cylindrical sterilizing fluid chamber 132 having a bottom end wall 134 containing a weakened piercing area 136. Parallel to or forming an extension of the bottom wall 134 is a lower locating collar 138, having a rounded exterior circular edge 140 for purposes which will appear.

Disposed in surrounding relation to the shoulder portion 128 is an upper, enlarged diameter locking collar 142 having a first pair of thin slots 144 joined at their ends to a second set of wider slots 146. Functionally, the upper flange 142 may be thought of as a holding and locking flange, with the lower flange 138 being considered a locating or guiding flange, as will appear. The smaller chamber 132 and the bag 124 are also made from a flexible thermoplastic material, with the chamber 132 being axially collapsible as its counterpart in FIGS. 1–6. The chambers 125, 132 are separated by a pierceable subdividing membrane 148.

Referring now to the spike and holder assembly generally designated 150, this unit will be seen to include a holder body 152 having a plurality of contoured surfaces 154 defining its side portions and serving to locate a fluid administration tube 156. The shank portion 158 of a spike generally designated 160 extends from the other end of the holder 150, and resembles its counterparts in FIGS. 1–6. In the embodiment shown, a pair of opposed bayonet locks generally designated 162 are also provided, with each lock including an offset leg 164 and an axially extending prong 166, which terminates in a tapered barb 168 of increased width and having a pointed leading edge portion 169 and an enlarged shoulder or locking portion 170.

In use, the embodiment of FIGS. 7–10 is similar to that of its counterpart, with only the locking and retaining action being slightly different. Thus, referring to FIG. 8, it is shown that when the manually positionable holder 152 is aligned with the sterilizing chamber 132, moving the holder axially toward the chamber causes the needle 160 to pierce the desired center area 136 of the end wall 134 with the needle. Guiding and centering of the needle is thereafter achieved by engagement between the exterior edges 140 of the locating flange 138 and the inside surfaces of the prong 166.

Figure 10:
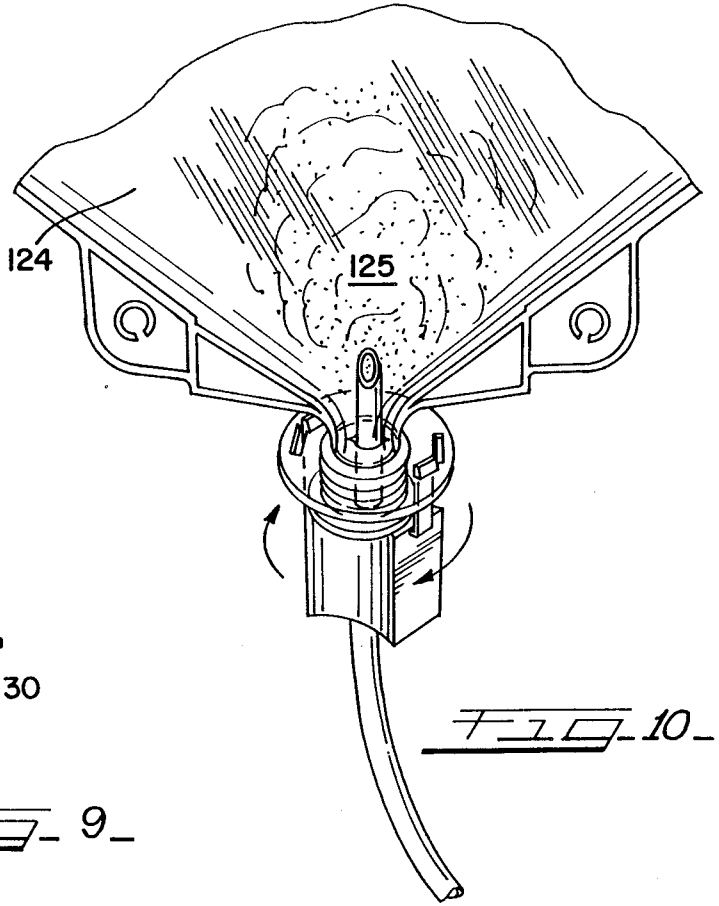
FIG. 10 is a fragmentary perspective view of the apparatus of FIGS. 7–9, showing the subdividing membrane being broken by the spike and the mixing action of the fluids created by expelling fluid from the smaller chamber into the larger chamber.
Figure 9:
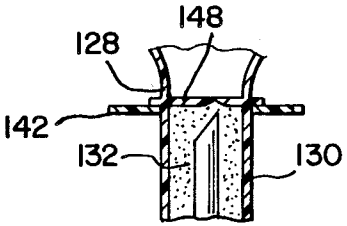
FIG. 9 is a fragmentary sectional view taken along lines 9—9 of FIG. 8.
Figure 8:
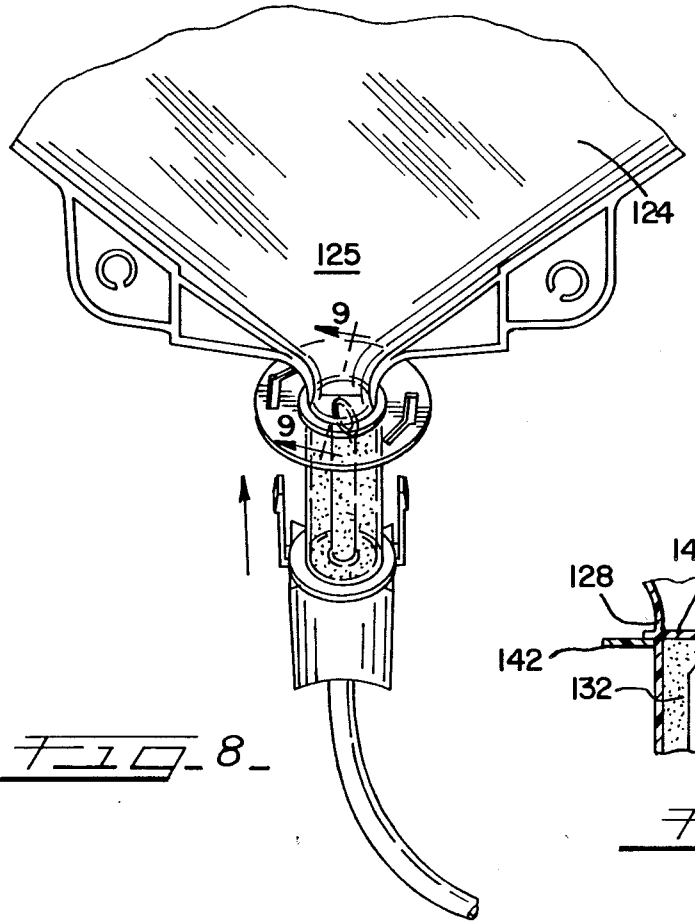
FIG. 8 is an assembled view of the components of FIG. 8.

A slight interference or friction fit is preferably provided in this area so that, once inserted to the position shown in FIG. 8, the needle remains immersed in the sterilizing solution contained in the smaller chamber 132. After elapse of a suitable time, an axial force is applied to the holder 152, exterting a compressive force on the chamber 132 and its contents. Upon slight movement, as shown in FIG. 9, for example, the membrane 148 is pierced by the needle tip and fluid is expelled from the sterilizing chamber into the larger chamber 125 of the bag 124 as shown in FIG. 10.

With this action, the prongs 166 of the holder 152 have engaged the set of enlarged width slots 44. Subsequently, twisting the entire assembly 150, as shown in FIG. 10, serves to move the prongs 166 into the narrower slots 146, thereby firmly locking the unit against accidental displacement.

As soon as the fluid has been expelled into the chamber 125 having the more dilute concentration thereof, the unit is ready for operation, with the sterilizing fluid is merely being diluted by the larger volume in the major container. Thus, functionally speaking, the apparatus operates in the same way as its counterpart, differing therefrom only in the structure of the bayonet lock and guide arrangement.

Both units, however, operate on the principle of immersing the spike in a sterilizing solution, retaining it there for a finite time and thereafter expelling the contents of the fluid in the sterilizing chamber into the larger chamber wherein fluid mixing takes place and whereby the spike is exposed to the fluid which will be administered. During initial manipulation, the tube 70 or 56 may be clamped off, and thereafter, the clamp may be released and fluid will flow into the patient for the dialysis process.

While it will be understood that a number of design variations may be made which still embody the concept of the invention, it is preferred that the smaller chamber be constructed so that its length is greater than that of the spike when the spike is fully inserted in the sterilizing chamber, but also preferred that the end of the spike, or other membrane piercing unit, have its end portion lying very near the separating membrane so that only slight axial movement of the spike, with or without the holder, is required to pierce the membrane. Inasmuch as the liquid in the sterilizing chamber is substantially incompressible, the spike or the membrane piercing element should lie close together. After the membrane is pierced, further axial movement of the spike and its handle serves to forcibly expel fluid from the smaller, sterilizing chamber into the larger chamber of the bag for mixing.

According to the invention, while sterilizing may be achieved by immersing the needle in a sterilizing solution, the net cost of the sterilizing fluid is nothing or minimal. This is because the sterilizing fluid becomes a part of the fluid actually administered and is not a separate ingredient which is discarded after use.

An advantage of the containers of the present invention is that they may readily be made with existing technology. The subdividing membrane may be formed by heat sealing a strip in place by ultrasonic welding, or by preforming and then inserting a frangible disk or the like with a locating and fastening flange in the form of a skirt or the like thereon.

The outer end face may be made by known methods and is only required to be of a type which forms a fluid-tight seal with needle inserted therethrough. This may comprise a plastic or rubber element which need not be novel per se.

The combination membrane piercing and spike holding and aligning unit such a the spike guide 50 shown in FIGS. 1 and 3, is preferably made from a rigid, sterilizable plastic material. It is apertured to permit fluid flow therethrough and provides a convenient way of aligning the needle, positioning the membrane-piercing tip 56 adjacent the membrane 46, while at the same time providing a safe and sure piercing action. Thus, comparing FIGS. 1 and 3, it will be seen that the needle may be inserted into the holder until the needle handle "bottoms out" on the holder. The user may readily detect this stage by "feel". At this point, the tip of the needle per se is spaced well apart from the membrane, but the tip of the holder lies very close to the membrane. Thus, a sort of forceful movement is required to pierce the membrane; this reduces the chance of accidental piercing and also calls for minimal movement of the needle holder, and consequently, minimal distortion of the sidewalls of the smaller chamber, assuming it is completely filled. Other advantages, including simplified manufacture and ease of use, will be apparent to those skilled in the art.

The method of the invention is also advantageous insofar as it is functionally safe, especially because the fluid in both chambers, when mixed, is always physiologically acceptable to the patient. In systems wherein the sterilizing fluid per se should not be administered, there was always the possibility of undesirable cross-contamination or carryover of fluid from the sterilizing bath to the fluid to be administered.

Referring now to other aspects of the invention, Table I, set forth above, related by way of example to the use of sodium chloride as the sterilizing agent. However, the invention is not limited to the use of any one type of sterilizing agent. In some cases, the apparatus of the invention may be used for the management of acute or short-term illness or injury, but it is likewise equally suitable, and in fact, more commonly used for chronic conditions. Consequently, the method of sterilizing the spike or other portion of the apparatus only requires immersing it in a material which is inherently lethal to, or is substantially hypo- or hypertonic in concentration with respect to a fluid which otherwise promotes bacterial culture growth.

Accordingly, one aspect of the method may be demonstrated by the use of "Betadine" or other antiseptic in the smaller chamber, in an amount suitable for sterilizing bacteria, but of such concentration that, when diluted by the much larger volume in the larger chamber, is still appropriate for introduction into the patient.

Another aspect of treatment involves treating the patient with a salt solution which is characteristic of the peritoneum, for example, and which, when administered, is isotonic with such concentration. For example, sodium acetate is a salt which may be present in the peritoneum in a certain millimeter concentration. According to the invention, the smaller chamber may be filled with a calculated amount of relatively concentrated sodium hydroxide, and the larger receptacle filled with an appropriate, more dilute concentration of acetic acid. The concentrations are selected so to be stoichiometric with respect to each other. Then the spike may be immersed in the sodium hydroxide for sterilizing purposes and the fluids thereafter mixed. This has the effect of making a sodium acetate solution of the desired millimeter concentration or normality, while taking advantage of the bactericidal properties of NaOH. Depending upon the application, this principle may be used with any number of physiologically acceptable fluids.

Referring now to another aspect of the invention, it is also possible to sterilize a bacterially contaminated environment by the use of 100% pure water. This method is set forth as an example of sterilizing by using a fluid which is hypotonic with respect to the concentration of a solution in which bacteria may grow. In this application, while the solution in the larger bag may be one which would support bacterial growth if bacteria were present therein, the fluid in the large bag is sterile when packaged, and the smaller chamber is filled with completely pure water. After the spike enters the completely pure water chamber and is permitted to remain there for a sufficient residence time, its bacterial contamination, if any, is completely eliminated and the fluids may thereafter be mixed. While this results in an increase in the solute concentration of the fluid in the smaller container or chamber, it illustrates the principle that as long as the fluid in the smaller chamber is either hypotonic or hypertonic in relation to a culture growth concentration, the invention is operative.

With materials such as distilled or completely pure water, sodium chloride, or the like, a residence time of perhaps five minutes is preferred. Other materials known to those skilled in the art may accomplish sterilization in a shorter or longer time.

While not a part of the invention per se, it is also preferred for a clamp or the like to be kept on the administration hose while the spike is in the smaller chamber as a reminder that fluid should not be permitted to flow through the apparatus while the spike in the smaller chamber. In other words, the clamp may serve as a reminder that the fluid should be mixed before they are administered.

Referring now to another matter, where mixing initially takes place as shown, for example in FIGS. 5 and 10, by a bellows or axial compressing action of the smaller chamber, a finite time is required to achieve complete mixing of the two fluids. It is not normally necessary to await complete mixing, however, as the patient is normally not succeptible to those slight variations in electrolyte concentration which result from mixing variations with time. In other words, as the fluid is reaching an equilibrium concentration, it may normally be administered without danger to the patient.

According to the invention, it is only necessary that materials of two different concentrations or compositions be used in isolated chambers and that the spike or equivalent used to pierce the fluid container be immersed in the first fluid and be allowed to reside there for a time sufficient to achieve bacterial destruction before the two are mixed in a common chamber from which the entire contents of both chambers are supplied to the patient.

Several preferred forms of spike holders and chambers have been shown for purposes of illustration, but the concept of the invention is not limited to the exact form shown. Likewise, a typical patient requiring chronic treatment has had a peritoneal dialysis catheter implanted beneath his skin in a known manner. In the practice of the invention, therefore, such patient need not visit the hospital, but instead may periodically perform the sequence of steps just referred to, namely, placing the spike in the smaller chamber, allowing it to become sterile, mixing the chamber contents and administering the fluid to his peritoneum through the catheter. After a suitable residence time, the contents of the peritoneum may be emptied into the same container and be discarded, and a subsequent container of fluid may be administered. According to estimates made in connection with researching the present invention, the cost of peritoneal dialysis may be reduced by at least one-half using apparatus and methods of to the present invention; this is anticipated to reduce direct patient and/or government costs in the amount of $10,000 to $15,000 per patient per year. Needless to say, in those patients wherein financial considerations rule out alternate treatment, the present invention is very valuable. In addition, many foreign countries lack the hospital facilities required t provide dialysis and it is anticipated that the invention will prove desirable in such environments.

It will be seen that the present invention provides an improved fluid administration apparatus and method, having a number of advantages and characteristics, including those referred to herein and others which are inherent in the invention. Several preferred embodiments of the invention having been described by way of illustration, it will occur to those skilled in the art that changes and variations to the illustrated embodiments may be made without departing from the spirit of the invention or the scope of the appended claims.

We claim:

1. A combination fluid administration and sterilizing assembly, comprising, in combination, a first fluid chamber defined in part by imperforate side and end walls and adapted to contain a first fluid which is pharmacologically acceptable to a patient to whom said fluid is to be administered, and which is of a non-bactericidal character and concentration, said fluid administration assembly further including a second chamber defined in part by imperforate side and outer end walls, said outer end wall of said second chamber being pierceable by the hollow, fluid conducting spike portion of a fluid administration conduit assembly, and being contructed and arranged so as to form a fluid-tight connection with the exterior of said hollow, fluid conducting spike, said first and second chambers of said assembly being separated from each other by a pierceable subdividing membrane, and said second chamber being adapted to contain a second a fluid which is pharmacologically compatible with, but of a different character or concentration from said first fluid, said second fluid providing an environment which is destructive to bacteria, said second chamber being constructed and arranged so as to permit said spike to pierce said outer end wall of said second chamber and remain positioned with respect to said second chamber while said hollow fluid conducting spike is exposed to said bactericidal environment in said second chamber, said imperforate side wall of said second chamber being flexible so as to permit subsequent axial movement of said spike to pierce said pierceable subdividing membrane so as to permit mixing of said first and second fluids and administration of said mixed fluids to said patient by passing said mixed fluids through said hollow fluid conducting spike and the remainder of said fluid adminstration conduit assembly, while said hollow, fluid conducting spike remains fixed relative to said outer end wall of said second chamber.

2. A combination fluid administration and sterilizing assembly as defined in claim 1 wherein said second fluid chamber is of cylindrical configuration.

3. A combination fluid administration and sterilizing assembly as defined in claim 2 wherein said second chamber includes probe means for receiving and positioning said fluid administration conduit assembly which includes a conduit and said spike.

4. A combination fluid administration and sterilizing assembly as defined in claim 3 wherein which further comprises a slotted mounting ring extending circumferentially around an upper portion of said second chamber and lying adjacent said pierceable subdividing membrane, and said mounting ring recieving said locking element of said fluid conduit assembly when said fluid is being administered.

5. A combination fluid administration and sterilizing assembly as defined in claim 3 wherein said probe means is constructed and arranged so as to provide resistance to unintentional piercing of said pierceable subdividing membrane.

6. A fluid administration apparatus comprising a fluid receptacle and a fluid administration conduit assembly having a hollow fluid administration tube, a handle and a hollow spike unit extending axially outwardly from said handle said handle and said fluid tube being adapted to be positioned exterior to said receptacle and said spike being adapted to be positioned within said receptacle, said spike including a shank and a tip, and said receptacle comprising, in combination a first fluid chamber defined in part by imperforate side and end walls and adapted to contain a first fluid which is pharmacologically acceptable to a patient to whom said fluid is to be administered, and which is of a non-bactericidal character and concentration, and a second chamber defined in part by imperforate side and outer end walls, said outer end wall of said second chamber being pierceable by said spike, and being constructed and arranged so as to form a fluid-tight connection with said spike, said first and second chambers being separated from each other by a pierceable subdividing membrane, and said second chamber being adapted to contain a second fluid which is pharmacologically compatible with, but of a different character or concentration from said first fluid, said second fluid providing an environment which is destructive to bacteria, said imperforate side wall of said second chamber being flexible so as to permit subsequent axial movement of said spike to pierce said outer end wall of said second chamber and remain positioned with respect to said second chamber while said spike is exposed to said bactericidal environment in said second chamber, and to permit subsequent movement of said spike to pierce said pierceable subdividing membrane so as to permit mixing of said first fluids and second fluids for administration of said mixed fluids to said patient by permitting said mixed fluid to pass through said spike and said hollow fluid administration tube.

7. A method of sterilization and fluid administration for dialysis, said method including the steps of providing a fluid receptacle subdivided into first and second compartments by a pierceable membrane and having a first fluid in said first compartment and a second fluid in said second compartment, with said first and second fluids being compatible with each other and pharmacologically acceptable for administration to a patient when mixed, one fluid providing an environment permissive of bacterial contamination and the other fluid being effective to sterilize the spike portion of a fluid administration conduit assembly placed therein and permitted to reside therein, the method further including the steps of inserting said spike portion of said fluid administration conduit assembly into one of said compartments containing said other fluid and permitting said spike portion to reside therein until sterilized, and subsequently manipulating said spike portion of said fluid adminstration conduit assembly so as to pierce said pierceable membrane to permit mixing of said first and second fluids with each other, and thereafter administering the fluids thereby mixed to a patient through said fluid administration conduit assembly

8. A method as defined in claim 7 wherein said one fluid is a dilute saline solution and said other fluid is a concentrated saline solution.

9. A method as defined in claim 7 wherein said one fluid is a solution which is isotonic in electrolyte concentration with respect to a solution found in the human peritoneal cavity, said other fluid being sterile, pure water.

10. A method as defined in claim 7 wherein said one fluid is a fluid which is isotonic in saline concentration with respect to the fluid found in the human peritoneal cavity and said other fluid is a germicide which is hypertonic in respect to a concentration of such solution which is acceptable to the peritoneal cavity but, which when diluted with said one fluid is pharmacologically acceptable to the peritoneal cavity.

11. A method as defined in claim 7 wherein said one fluid is an acid or acid salt and said other fluid is a base or base salt, with at least one of said fluids being capable of sterilizing said spike portion of said administration conduit assembly and said fluids, when combined, being capable of reacting to form a pharmacologically acceptable salt solution.

12. A method as defined in claim 11 wherein said lease is a solution of sodium hydroxide and said acid is a solution of hydrochloric acid, said solutions being, when mixed, stoichiometrically neutral.

* * * * *